US012643051B2

(12) United States Patent
Carbonar et al.

(10) Patent No.: US 12,643,051 B2
(45) Date of Patent: Jun. 2, 2026

(54) IMAGE PRESENTATION SYSTEM FOR AMUSEMENT PARK ATTRACTION SYSTEM

(71) Applicant: Universal City Studios LLC, Universal City, CA (US)

(72) Inventors: Andrew Carbonar, Orlando, FL (US); Gregory Hall, Orlando, FL (US); Darrin Hughes, Orlando, FL (US); Michael Wadsworth, Orlando, FL (US); William Rodriguez, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 859 days.

(21) Appl. No.: 17/903,689

(22) Filed: Sep. 6, 2022

(65) Prior Publication Data

US 2024/0075394 A1 Mar. 7, 2024

(51) Int. Cl.
*A63G 31/02* (2006.01)

(52) U.S. Cl.
CPC ..... *A63G 31/02* (2013.01)

(58) Field of Classification Search
CPC ... G03B 21/562; A63J 5/021; A63J 2005/001; A63G 31/02
See application file for complete search history.

(56) References Cited

U.S. PATENT DOCUMENTS 9,278,292 B2 * 3/2016 Vance ..... A63G 1/02
2009/0046258 A1 * 2/2009 Schnuckle ..... G03B 21/14 353/94
2009/0084285 A1 * 4/2009 Verl ..... A63G 31/16 104/53
2010/0062866 A1 * 3/2010 Schnuckle ..... A63G 31/16 472/78
2011/0141246 A1 * 6/2011 Schwartz ..... H04N 13/363 348/53

(Continued)

FOREIGN PATENT DOCUMENTS

CN 101428182 A 5/2009
CN 102150094 B 6/2014

(Continued)

OTHER PUBLICATIONS

CN118482305 (Year: 2024).*

(Continued)

*Primary Examiner* — Joseph S Del Sole
(74) *Attorney, Agent, or Firm* — Fletcher Yoder, P.C.

(57) ABSTRACT

An image presentation system for an amusement park includes a first display with an opening extending therethrough, wherein at least a portion of the first display is viewable from a viewing area, a movable arm, wherein the movable arm is positioned within the opening, a second display supported by the movable arm and offset from the first display, wherein the second display conceals the opening from the viewing area, and a controller configured to provide a first image via the first display and a second image via the second display such that the second image comprises an image effect that accounts for the offset and coordinates with the first image to present as though the first image and the second image are a single image displayed by the first display.

20 Claims, 5 Drawing Sheets

(56) References Cited

U.S. PATENT DOCUMENTS

| | | | | |
|---|---|---|---|---|
| 2015/0352452 | A1* | 12/2015 | Vance | A63G 7/00 472/59 |
| 2018/0107104 | A1* | 4/2018 | Otte | F41G 3/2633 |
| 2019/0134516 | A1* | 5/2019 | Bluhm | A63G 7/00 |

FOREIGN PATENT DOCUMENTS

| | | | | |
|---|---|---|---|---|
| CN | 118482305 | A * | 8/2024 | G03B 21/562 |
| KR | 970000788 | Y1 * | 2/1997 | G03B 21/132 |
| KR | 20060055993 | A * | 5/2006 | H04N 9/3141 |
| WO | 9848912 | A1 | 11/1998 | |

OTHER PUBLICATIONS

KR20060055993 (Year: 2006).*
KR970000788 (Year: 1997).*
PCT/US2023/031439 International Search Report and Written Opinion mailed Dec. 21, 2023.

* cited by examiner

IMAGE PRESENTATION SYSTEM FOR AMUSEMENT PARK ATTRACTION SYSTEM

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Throughout amusement parks and other entertainment venues, special effects can be used to help immerse guests in the experience of a ride or attraction. Immersive environments may include physical props and set pieces, robotic or mechanical elements, and/or display surfaces that present media. In addition, the immersive environment may include audio effects, smoke effects, and/or motion effects. With the increasing sophistication and complexity of modem ride attractions and the corresponding increase in expectations among patrons, improved and more creative attractions are desirable, including ride attractions having more complex, immersive, and/or realistic special effects.

BRIEF DESCRIPTION

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, an image presentation system includes a first display with an opening extending therethrough wherein at least a portion of the first display is viewable from a viewing area. Further, the system includes a movable arm positioned within the opening, a second display supported by the movable arm and offset from the first display concealing the opening from the viewing area, and a controller. The controller is configured to provide a first image via the first display and a second image via the second display such that the second image comprises an image effect that accounts for the offset and coordinates with the first image to present as though the first image and the second image are a single image displayed by the first display.

In an embodiment, a method including determining, via a controller, a point of view of a viewer, displaying, via the controller, a first image on a first display comprising a hole, and displaying, via the controller, a second image on a second display disposed on a movable member extending through the hole. The second display is positioned to conceal the hole from the point of view of the viewer, and the second image is configured to conceal the second display by presenting as though the first image and the second image are a single image displayed by the first display from the point of view of the viewer.

In an embodiment, a non-transitory computer-readable medium including instructions that, when executed by processing circuitry, cause the processing circuitry to perform operations including determining first image data and second image data for presentation based on detected positioning of a viewing area, initiating presentation of a first image based on the first image data on a first display having an opening extending therethrough, and initiating presentation of a second image based on the second image data on a second display supported by a movable arm extending through the opening. The second display is offset from the first display and the second display conceals the opening from the viewing area, and the second image comprises an image effect that accounts for the offset and coordinates with the first image to present as though the first image and the second image are a single image displayed by the first display.

DRAWINGS

These and other features, aspects, and advantages of present embodiments will become better understood when the following detailed description is read with reference to the accompanying drawings in which like characters represent like parts throughout the drawings, wherein.

Figure 5:
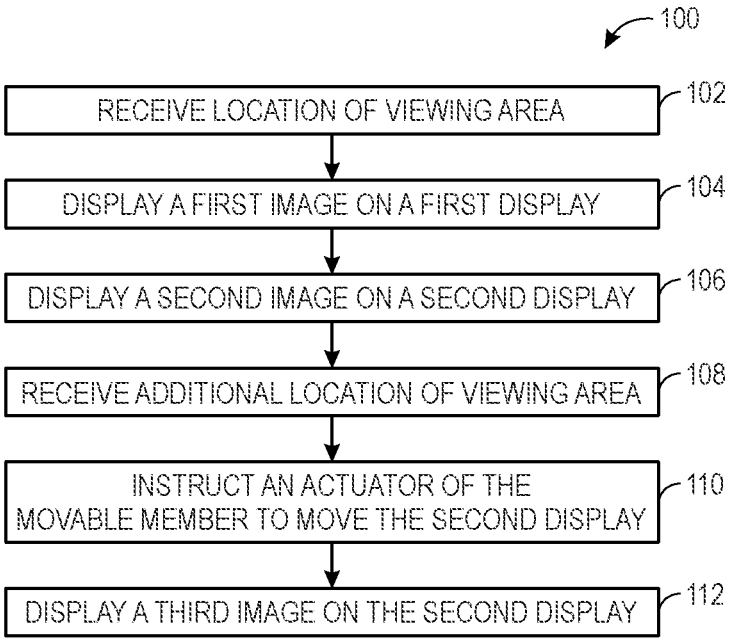
Figure 6:
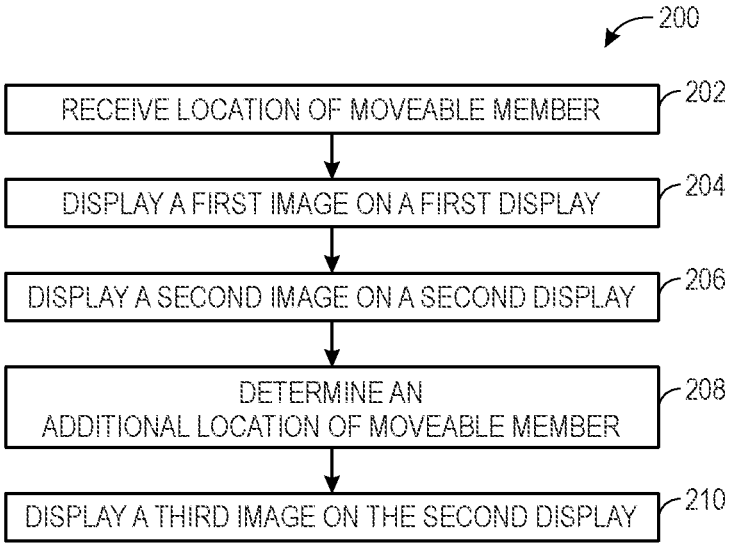

FIG. 5 is a flowchart of an embodiment of a method or process for operating an image presentation system of an amusement park attraction system, in accordance with an aspect of the present disclosure; and FIG. 6 is a flowchart of an embodiment of a method or process for operating an image presentation system of an amusement park attraction system, in accordance with an aspect of the present disclosure.

DETAILED DESCRIPTION

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment"

or "an embodiment" of the present disclosure are not intended to be interpreted as excluding the existence of additional embodiments that also incorporate the recited features.

The present disclosure is directed to an attraction system such as may be provided in an entertainment venue (e.g., an amusement park or theme park). The entertainment venue may include a variety of features, such as rides (e.g., a roller coaster), display screens, theatrical shows, performers, and/or show set props (e.g., characters, animated figures). The attraction system of the amusement park may also include an image presentation system configured to facilitate entertaining guests by displaying images on a screen in coordination with one or more of the variety of aforementioned amusement park features. For example, the image presentation system may present various visual and/or animated effects to guests in coordination with actions performed by or presentation of the variety of amusement park features within the attraction system.

As an example, the image presentation system may include one or more show effects such as a display, an animated show figure (e.g., a mechanically activated animated figure), and so forth. Such show effects may be operated to enable guests to perceive a certain atmosphere, such as a realistic and/or immersive environment to entertain the guests. In accordance with present embodiments, a display may present various visual effects in coordination with an animated show figure positioned at a particular location substantially in front of the display. Thus, during operation of the attraction system, the guests may be positioned to view the animated show figure as appearing in front of and in coordination with the display. Support of the animated show figure may involve the animated show figure being coupled to a structure extending substantially in front of and potentially obstructing (e.g., blocking) the display from a point of view (e.g., visual perspective) of the guests. Further, in certain embodiments, the support may include a movable arm and the animated show figure may be controllably animated and/or moved about relative to the viewing area via the movable arm (e.g., equipment boom, robotic arm). Such movement may further obstruct the display from the point of view of the guests. Accordingly, present embodiments are directed to concealing such obstruction. For example, the display may include an opening (e.g., gap, slot, port, hole, break) through which the movable arm may extend and attach (e.g., fasten, couple, join) to the animated show figure. The hole in addition to the movable arm may further obstruct the display and as a result disrupt (e.g., interrupt, ruin, obscure) the intended various visual effects. However, an additional display may coordinate with the display and other aspects or characteristics of the system (e.g., movement, changes in viewing perspective) to conceal such obstructions. Thus, the entertainment provided by the realistic and/or immersive environment of the image presentation system may be increased relative to allowing such obstructions to go unmitigated.

As suggested above, it may be desirable to enable movement and/or animation of a show figure in front of a display in coordination with various visual effects of the display while concealing a movable arm which supports the show figure, and the opening in the display through which the movable arm extends. Accordingly, embodiments of the present disclosure are directed to an attraction system that includes an image presentation system configured to provide a visually realistic environment to a viewing area by concealing structural and/or movable equipment (e.g., robotic arm) and/or an opening in the display through which the movable equipment extends from the point of view of a viewing area. Components of the image presentation system may include a first display, a control system, and a movable arm. In addition, the image presentation system may include a second display and a show figure (e.g., animated figure, animated object, robot) that may be coupled to, disposed on, or otherwise accommodated by the movable arm, such that movement of the movable arm via one or more actuators may collectively move the second display and the show figure as a unit or group. In other words, movement of the movable arm may drive corresponding movement of the second display and the show figure.

Furthermore, the components of the image presentation system may be configured to operate during use of the attraction system. For instance, the components of the image presentation system may operate in coordination with each other to produce a desired visual entertainment while concealing any structural and/or actuating components of the image presentation system from the point of view of the viewing area. As an example, the first display may present an image depicting a particular scene, while the show figure may be an object or character depicted as surrounded by the scene of the first display. The show figure may be moved via the movable arm relative to the scene and be operated to portray a reaction and/or to interact with the scene depicted by the first display. Further, the movable arm may be positioned to extend through a hole in the first display and couple to the show figure. In this manner, the movable arm may drive the movement of the show figure. The image presentation system of the present embodiments also includes a second display coupled to the movable arm. The second display may be positioned to physically conceal the hole in the first display and the movable arm from the viewing area (e.g., by being in front of and extending beyond a visual area including the hole and the movable arm with respect to the viewing area). In addition, the second display may be configured to present an image containing image effects that are coordinated with the image of the first display. The image effects may enable the second display to effectively conceal the visual area including the hole of the first display and the movable arm by creating an optical illusion such that, from the point of view of the viewing area, the image of the first display and the image of the second display combine in a way that provides an illusion suggesting that there is a unified scene (e.g., a single background or a single display presenting the same visual information). Thus, the components of the image presentation system may be operated to portray the movement of the show figure more realistically, such as to depict that the show figure is moving without usage of the support and the actuation by the movable arm, which are both concealed behind the second display. In this manner, the operation of the components of the image presentation system and the coordination of these components with each other may enhance the experience perceived by the guests in the viewing area.

Further, since the aforementioned components of the image presentation system may be separate from the viewing area, service, maintenance, and/or other operations may be performed with respect to the components of the image presentation system without modifying the viewing area. For example, the show figure may be modified, removed, added, and so forth, without modifying how a guest is positioned within the viewing area (e.g., to accommodate modification of the image presentation system). Thus, the image presentation system may be more easily modified (e.g., updated, serviced, and/or adjusted) to provide a desired visual entertainment to the viewing area.

Figure 1:
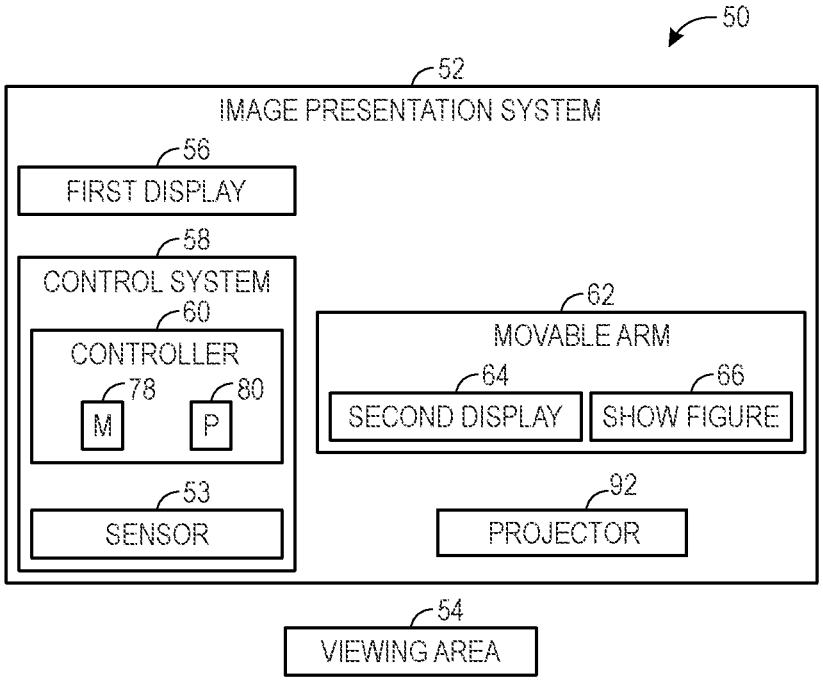
FIG. 1 is a schematic diagram of an embodiment of an attraction system that includes an image presentation system and a viewing area, in accordance with an aspect of the present disclosure.
Figure 2:
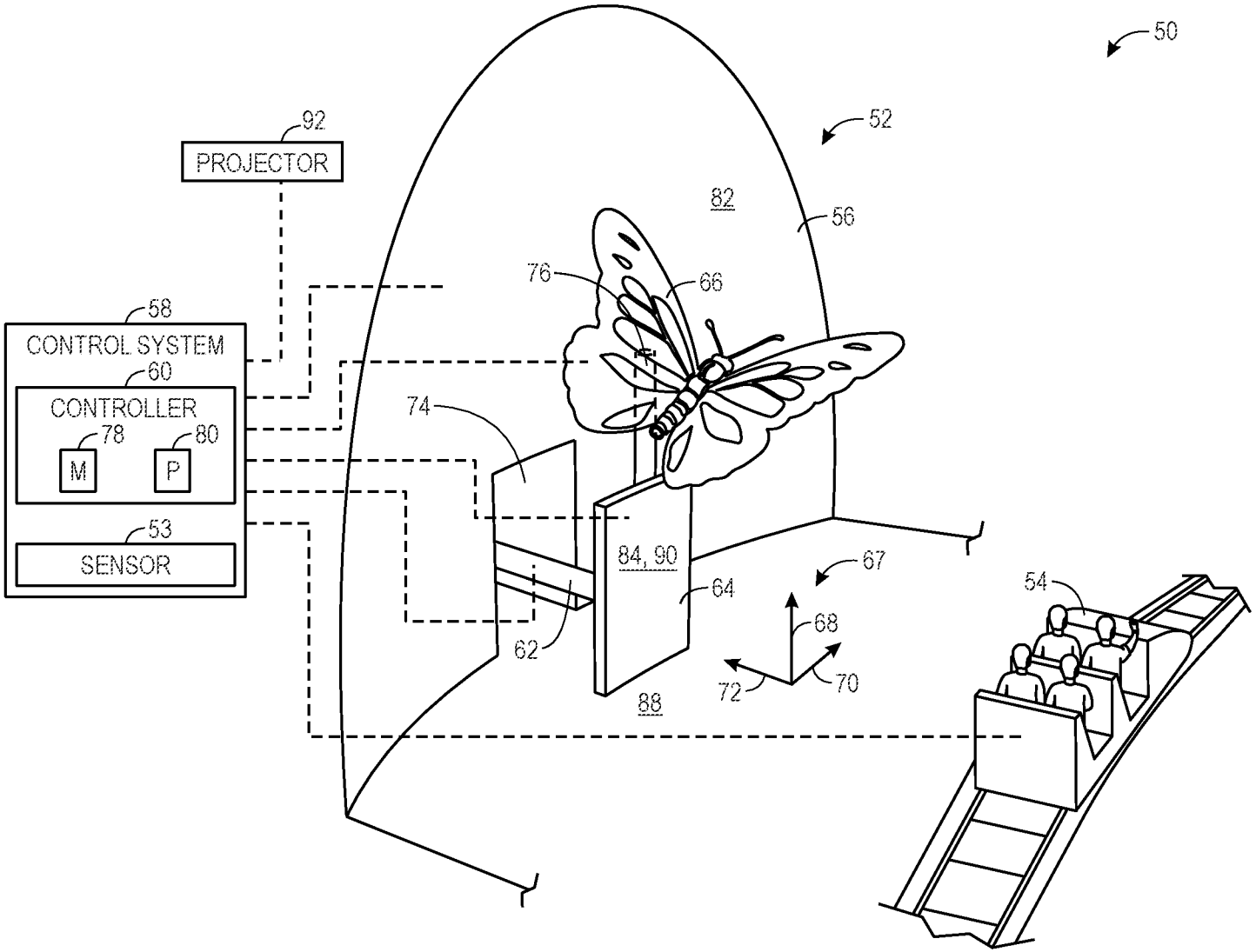
FIG. 2 is a schematic perspective view of an embodiment of an attraction system that includes an image presentation system and a viewing area, in accordance with an aspect of the present disclosure.

With the preceding in mind, FIG. 1 is a schematic diagram of an embodiment of an attraction system 50 that includes an image presentation system 52 and a viewing area 54. The image presentation system 52 includes a first display 56, a control system 58 comprising one or more controllers 60, and a movable arm 62. In addition, the image presentation system 52 includes a second display 64 and a show figure 66 (e.g., animated figure, animated object, robot) that may be coupled to, disposed on, or otherwise accommodated by the movable arm 62. Further, FIG. 2 is a schematic perspective view of the attraction system 50 of FIG. 1.

To facilitate discussion, FIG. 1 and FIG. 2 will be described together and the components of the attraction system 50 will be discussed in relation to directional viewing perspectives 67 represented by a vertical axis 68, a lateral axis 70, and a depth axis 72. These directional viewing perspectives 67 represent general viewing directions from the viewing area 54. The image presentation system may include the first display 56 substantially positioned behind and around the show figure 66 with respect to the point of view of the viewing area 54. In particular, from the point of view of the viewing area 54, the first display 56 may be positioned behind the show figure 66 with respect to the depth axis 72. In this way, the first display 56 (e.g., an LED screen or a screen upon which a projection is made) may present visual effects (e.g., images, image data, video imagery, visual scene) that coordinate with the show figure 66. For example, the visual effects may include a scene or environment in which the show figure 66 appears to interact when viewed from the viewing area 54. As a specific example, the show figure 66 may represent a butterfly and the visual effects displayed by the first display 56 may depict a field of flowers in which the butterfly may be interacting. In addition, the first display 56 may include a hole 74 (e.g., opening, gap, break) in which the movable arm 62 may extend through and/or be positioned within the hole 74. The hole 74 may be completely surrounded by the first display 56 or may include an opening such as depicted in FIG. 2, wherein the hole 74 is only partially surrounded by the first display 56. The movable arm 62 may support and coordinate movement of the show figure 66 relative to the visual effects environment presented by the first display 56. For example, the show figure 66 may be moved by the movable arm 62 relative to the visual effects environment presented by the first display 56 to produce an appearance of a butterfly (as represented by the show figure 66) flying through a field of flowers (as depicted on the first display 56). The position of the hole 74 in the first display 56 may enable the show figure 66 coupled to the movable arm 62 to be suspended along the vertical axis 68 a particular distance away from (e.g., offset, apart from) a base surface (e.g., ground, stage surface, floor). In this way, the image presentation system 52 may produce a visual effect perceivable from the viewing area 54, such as the show figure 66 appearing to fly, float, levitate, and/or fall.

In the illustrated embodiment, the movable arm 62 (e.g., robotic arm, movable member) is positioned within the hole 74, and configured to support and position the second display 64 and the show figure 66 (e.g., animated figure) between the first display 56 and the viewing area 54. In some embodiments, the movable arm 62 may be an articulating robotic arm coupled to the show figure 66 with at least two degrees of freedom. For example, the movable arm 62 may be controllably actuated so as to move the show figure 66 generally along the vertical axis 68, the lateral axis 70, the depth axis 72, or any combination thereof, with respect to the point of view of the viewing area 54. Further, the movable arm 62 may also support a transmission line (e.g., one or more cables) that may extend along (e.g., within, beside) the movable arm 62 and may supply power and/or data to the second display 64 and/or the show figure 66. As an example, power supplied via the transmission line may enable the show figure 66 be animated to portray a reaction or to interact with visual effects and/or other show elements of the attraction system 50. In this manner, operation and amination of the show figure 66 may enhance the experience perceived by the guests. In some embodiments, the image presentation system 52 may also include a support structure 76 coupled to and extending from the movable arm 62. The support structure 76 may be used to couple the show figure 66 to the movable arm 62 in a desired configuration. Additionally, the show figure 66 may be positioned on the support structure 76 so as to conceal the support structure 76 and/or at least a portion of the second display 64 from the viewing area 54. For example, in the illustrated embodiment, a body and wing of the show figure 66 conceal the support structure 76 from viewing from the viewing area 54. In this way, the support structure 76 may enable the show figure 66 to be positioned between the second display 64 and the viewing area 54 without being obstructive or breaking immersion in a narrative.

Figure 4:
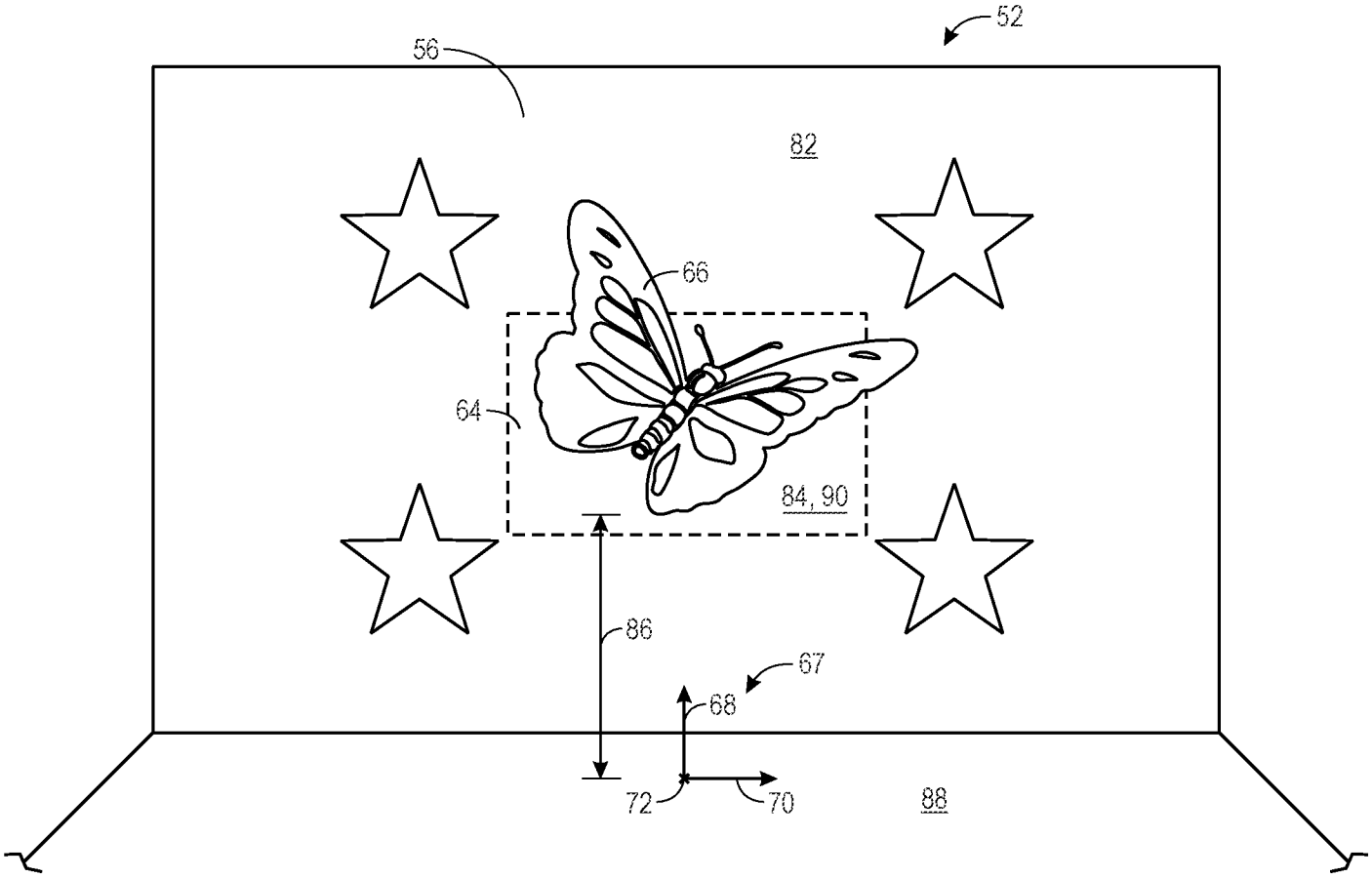
FIG. 4 is a schematic perspective view of an embodiment of the image presentation system of FIG. 3 from a point of view of the viewing area, in accordance with an aspect of the present disclosure.

In the illustrated embodiment, the image presentation system 52 also includes the second display 64 coupled to movable arm 62. The second display 64 may be coupled to an end of and/or on a side of the movable arm 62 and positioned to conceal the movable arm 62 and the hole 74 from the viewing area 54. Additionally, the second display 64 may be positioned at least partially behind the show figure 66, with respect to the depth axis 72. In this way, a portion of the show figure 66 may cover (e.g., conceal, obstruct) a portion of the second display 64 with respect to the viewing area 54. In other embodiments, the second display 64 may surround and extend from the movable arm 62, such that at least a portion of the movable arm 62 may extend through the second display 64, as illustrated in FIG. 4. Additionally, the second display 64 may be positioned to visually block (e.g., conceal, hide) the hole 74 in the first display 56 from the point of view of viewing area 54. For example, the second display 64, coupled to the movable arm 62, may be positioned offset of (e.g., some distance apart) and/or in front of the first display 56 such that edges of the second display 64 visually extend beyond and completely cover edges of the hole 74 in the first display 56, with respect to the point of view of the viewing area 54. Further, the second display 64 may present additional visual effects (e.g., images, image data, video imagery) including image effects (e.g., distortion effects, modified perspective effects, warping effects) that coordinate with the visual effects of the first display 56.

The image effects of the second display 64 may account for the offset distance from the first display 56 and coordinate with the visual effects of the first display 56 to present as though a first image 82 displayed on the first display 56 and a second image 84 on the second display 64 are a common image (e.g., single image, seamless image) at a common depth substantially equal to the depth of the first display 56, with respect to the viewing area 54. To create this illusion, the second image may be generated based on a shape of the second display 64, a position of the second display 64 relative to the first display 56 and the viewing area 54, and the first image 82. In this way, the first display 56 and the second display 64 may present images with complementary geometries that enable the hole 74 and the movable arm 62 to be visually concealed from the point of view of the viewing area 54. In other words, from the point of view of the guest (e.g., viewer) in the viewing area 54, the second display 64, the hole 74, and the movable arm 62 may effectively essentially disappear as the image effects of the second display 64 together with the visual effects of the first display 56 may create an optical illusion that enables the image presentation system 52 to present the show figure 66 couple to the movable arm 62 as suspended or unsupported within the imagery of the first display 56.

It should be appreciated that the first and/or second displays 56, 64 may present any number of images (e.g., image data, video imagery.) Furthermore, in some embodiments, the images displayed by the first and/or second displays 56, 64 may be displayed consecutively, such as for video imagery. For example, in the illustrated embodiments, the second display 64 may present a third image 90 (e.g., fourth image, fifth image, nth image) subsequent the second image 84 on the second display 64, that may incorporate the image effects, as discussed herein, to account for the offset distance from the first display 56 and coordinate with the visual effects of the first display 56 to present as though the first image 82 displayed on the first display 56 and the third image 90 on the second display 64 are a common image (e.g., single image, seamless image) at a common depth substantially equal to the depth of the first display 56, with respect to the viewing area 54. Additionally, the third image 90 (e.g., fourth image, fifth image, nth image) may be generated based on a shape of the second display 64, a position of the second display 64 relative to the first display 56 and the viewing area 54, and the first image 82. In this way, as discussed herein, the first display 56 and the second display 64 may present images with complementary geometries that enable the hole 74 and the movable arm 62 to be visually concealed from the point of view of the viewing area 54.

In some embodiments, the first display 56 and/or the second display 64 may be electronic displays or projection displays that enable graphical and/or visual output to be displayed to the viewing area 54. The displays may use any suitable backlit or front lit display technology, and may include an electroluminescent (ELD) display, liquid crystal (LCD) display, light-emitting diode (LED) display, organic LED (OLED) display, active-matrix OLED display, plasma display panel (PDP), quantum dot LED (QLED) display, and so on. Further, in some embodiments, the edges of the second display 64 may be beveled or curved (e.g., to avoid harsh edges) to aid in visually concealing the second display 64. Moreover, the first display 56 and/or the second display 64 may be screens that enable projected images and/or video imagery to be viewed by the viewing area 54. For example, as seen in the illustrated embodiments, the image presentation system 52 may include a projector 92 that projects the imagery onto the first display 56 and/or the second display 64. Additionally, in some embodiments, a shape (e.g., surface, walls, faces) of the first display 56 and the second display 64 may be substantially flat (e.g., each extend in a respective single plane). In other embodiments, the shape of the first display 56 and/or the second display 64 may extend in a curve substantially concave with respect to the point of view of the viewing area 54. Further, the first display 56 and the second display 64 may each comprise concave curves that are complementary to each other. In the illustrated embodiment, the first display 56 comprises a concave curve and the second display 64 is substantially flat, as illustrated in FIG. 2.

The viewing area 54 and the image presentation system 52 may change positions relative to each other. Accordingly, the first display 56, the second display 64, the movable arm 62, and/or the show figure 66 may be configured to operate in response to a relative location change with respect to the viewing area 54, which may correspond to a point of view and/or a position of a guest (e.g., a viewer), a group of guests, and/or a vehicle of the attraction system 50. For example, the viewing area 54 (which may represent a ride vehicle) may be mobile, such as a ride vehicle containing one or more guests of the attraction. The ride vehicle may traverse a path (e.g. a track on which it is disposed) substantially in front of the first display 56 of the image presentation system 52 and its position may be detected or monitored with one or more sensors 53 (e.g., a camera, barcode reader, pressure sensor). As a result of such a position change, the point of view (e.g., visual perspective, perception angle) of the viewing area 54, with respect to the first display 56, may change depending on the position of the guest, the group of guests, and/or the ride vehicle. Therefore, the point of view of the viewing area 54 may determine the operations of the first display 56, the second display 64, the movable arm 62, and/or the show figure 66 in order to effectively coordinate with the visual effects observable by the viewing area 54 to produce the realistic and/or immersive environment of the attraction. Data regarding such a point of view change may be acquired based on the one or more sensors 53 or other feedback indicating such a change. For example, a ride control system may monitor positioning (e.g., using position sensors) of a ride vehicle, identify positioning based on a time/position correlation, and/or the like.

Additionally, in the illustrated embodiment, the image presentation system 52 also includes the control system 58. The control system 58 may include one or more controllers 60, a memory 78, and processing circuitry 80. The memory 78 may include volatile memory, such as random access memory (RAM), and/or non-volatile memory, such as read-only memory (ROM), optical drives, hard disc drives, solid-state drives, or any other non-transitory computer-readable medium that includes instructions. The processing circuitry 80 may be configured to execute such instructions. For example, the processing circuitry 80 may include one or more application specific integrated circuits (ASICs), one or more field programmable gate arrays (FPGAs), one or more general purpose processors, or any combination thereof. Further, the control system 58 may be communicatively coupled to the first display 56, the second display 64, the movable arm 62, the one or more sensors 53, and/or the show figure 66. For instance, the control system 58 may provide (e.g., send, transmit) the visual effects and/or the image effects to the first display 56 and/or the second display 64. In some embodiments, the control system 58 may be communicatively coupled to the projector 92 and may provide the visual effects and/or the image effects to the projector 92 to be displayed by the first display 56 and/or the second display 64. Further, the control system 58 may modify imagery (e.g., image data, video imagery) provided to the first display 56 and/or the second display 64 that may enable the modified imagery to effectively conceal the hole 74 in the first display 56 and the movable arm 62 coupled to the show figure 66 from the viewing area 54. In particular, the control system 58 may modify the imagery provided to the first display 56 and the second display 64 based on the point of view of the viewing area 54 which may correspond to a changing location of the viewing area 54. For example, the viewing area 54 may be a guest travelling along a path (e.g., tracks) of the attraction system 50. The point of view of the guest may change as the guest location changes in relation to the first display 56 and the second display 64.

Further, the control system 58 may determine the location of the guest which corresponds the point of view of the guest, and modify the imagery provided to the first display 56 and the second display 64 in response to determining the location of the guest. As noted above, the control system 58 may identify relative location information based on the one or more sensors 53, which may include a camera and software configured to detect human faces and viewing positions.

Additionally, the control system 58 may actuate the movable arm 62 based on the point of view of the viewing area 54 which may correspond to the changing location of the viewing area 54. In particular, the control system 58 may continuously determine the point of view of the viewing area 54 to enable the second display 64 to remain positioned to effectively conceal the hole 74 in the first display 56 despite the changing location of the viewing area 54. Using the foregoing example, the control system 58 may determine the location of the guest which corresponds to the point of view of the guest, as the guest traverses the path proximate the first display 56 and the second display 64. The control system 58 may then actuate the movable arm 62 to adjust the second display 64 coupled to the movable arm 62 to conceal the hole 74 from the point of view of the guest, in response to determining the location of the guest. In some embodiments, the location of the viewing area 54 may be predetermined and thus the imagery provided to the first display 56 and the second display 64 as well as the actuation of the movable arm 62 may be pre-programmed into the image presentation system 52. In other embodiments, the location of viewing area 54 may be variable and determined by the control system 58 by receiving data from one or more sensors (e.g., the sensor 53) positioned throughout the attraction system 50. It should be noted that, in some embodiments, the second display 64 may be movable separately from the show figure 66. For example, two separate movable arms 62 may extend through the hole 74 and respectively couple to the show figure 66 or the second display 64. In yet another example, an additional actuation mechanism may extend from the movable arm 62 to guide the show figure 66 or the second display 64.

In some embodiments, actuation of the movable arm 62 may be required to facilitate presentation of the desired visual entertainment of the attraction system 50 to the viewing area 54. Specifically, the actuation of the movable arm 62 may enable the movement of the show figure 66 coupled to the movable arm 62 to be in coordination with the visual effects of the first display 56 which may create the desired visual entertainment. For example, the first display 56 may present visual effects of realistic scenery depicting a space station in outer space and the show figure 66 may be an astronaut performing a spacewalk. In this way, the astronaut may be moved by the movable arm 62 about the scenery presented by the first display 56 to appear as though the astronaut is floating (e.g., suspended) in outer space. As a result, the actuation of the movable arm 62 to move the show figure 66 would also cause movement of the second display 64 coupled to the movable arm 62. Thus, in the some embodiments, the second display 64 may be configured to operate in response to the actuation of the movable arm 62. For instance, as discussed herein, the second display 64, coupled to the movable arm 62, may be positioned to cover the hole 74 in the first display 56 and may present the image effects that coordinate with the visual effects of the first display 56 to conceal the hole 74 and the movable arm 62 from the viewing area 54. In response to the actuation of the movable arm 62 to move the show figure 66, the second display 64 may present additional image effects to continuously create and/or sustain the optical illusion that enables the second display 64 to conceal the movable arm 62 and/or the hole 74 in the first display 56 from the viewing area 54. In some embodiments, the control system 58 may provide the image effects to the second display 64 in response to determining the position of the movable arm 62 and/or the position of the second display 64. In some embodiments, the position of the movable arm 62 and/or second display 64 may be pre-determined and thus the imagery provided to the second display 64 as well as the actuation of the movable arm 62 may be pre-programmed into the image presentation system 52. In other embodiments, the position of the movable arm 62 and/or second display 64 may be determined by the control system 58 by receiving data from one or more sensors positioned throughout the attraction system 50. It should be noted that, by blending the imagery of the second display 64 with that of the first display 56, the second display 64 itself is also effectively concealed or camouflaged because it creates the impression that only the background is being observed.

Figure 3:
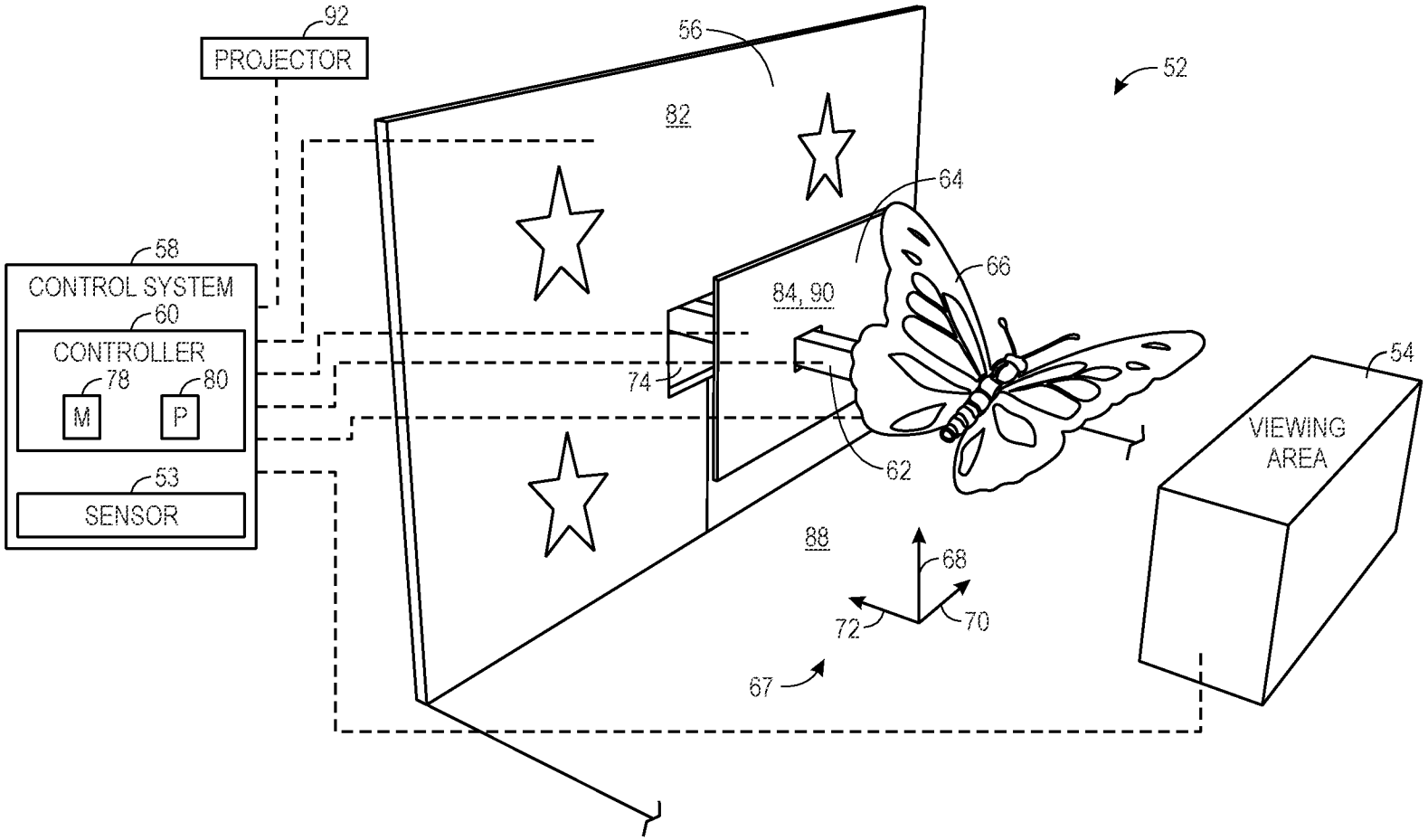
FIG. 3 is a schematic side view of an embodiment of an image presentation system and a viewing area, in accordance with an aspect of the present disclosure.

To further illustrate how the image presentation system 52 effectively conceals the hole 74 in the first display 56, and the movable arm 62, FIG. 3 is a schematic view of an embodiment of the image presentation system 52 when viewed from the side, and FIG. 4 is a schematic view of the image presentation system 52 when viewed from the point of view of the viewing area 54. In particular, the image presentation system 52 of the illustrated embodiments includes the second display 64 offset from the first display 56 and coupled to and surrounding the movable arm 62, which is coupled to the show figure 66. In addition, the edges of the second display 64 extend beyond the edges of the hole 74 of the first display 56 through which the movable arm 62 extends. Further, the image presentation system 52 of the illustrated embodiments also includes the control system 58, which may include one or more controllers 60, a memory 78, and processing circuitry 80, as discussed herein.

In the illustrated embodiment, the first display 56 presents the first image 82 and the second display 64 presents the second image 84 that corresponds with the first image 82. From the perspective view of FIG. 3, the second display 64 along with the hole 74 in the first display 56 and the movable arm 62 are visually distinguishable from the first display 56. Moreover, the first image 82 and the second image 84 are also visually distinguishable and the edges of the second image 84 (e.g., the second display 64) can be easily perceived. However, when the image presentation system 52 is viewed from the point of view of the viewing area 54, as illustrated in FIG. 4, the hole 74 in the first display 56 and the movable arm 62 are visually concealed by the second display 64 and the show figure 66. Moreover, the first image 82 presented by the first display 56 and the second image 84 presented by the second display 64 appear as though they are a single image presented by the first display 56 and positioned behind the show figure 66, with respect to the depth axis 72. Indeed, the edges of the second image 84 and the second display 64 are not visually distinguishable from the first image 82 or the first display 56. Therefore, the hole 74, the movable arm 62, and effectively the second display 64 are concealed (e.g., hidden, camouflaged) from the point of view of the viewing area 54 and the show figure 66 appears to be suspended vertically, with respect to the vertical axis 68, a distance 86 from the ground 88.

Additionally, in some embodiments, as the movable arm 62, the viewing area 54, or both move (e.g., change location, translate) the second image 84 presented on the second display 64 is continually updated (e.g., adjusted) based on the location (e.g., movement) of the movable arm 62, the viewing area 54, or both. In other embodiments, the second display 64 may receive and display additional images (e.g., video imagery) based on the location of the movable arm 62, the viewing area 54, or both. As a result, the second image 84 maintains visual complementary geometries with respect to the first image 82 on the first display 56 so as to conceal the movable arm 62, the hole 74 in the first display, and the second display 64 from the point of view of the viewing area 54. In this way, the image presentation system 52 may enable sufficient entertainment of the attraction system 50 by providing the viewing area 54 with a visually realistic and immersive environment.

FIG. 5 is a flowchart of an embodiment of a method or process 100 for operating the image presentation system (e.g., the image presentation system 52 of FIGS. 1-4) of the attraction system 50. Any suitable device in accordance with present embodiments (e.g., the processing circuitry 80 of the control system 58 of FIGS. 1-3) may perform the method 100. In one embodiment, the method 100 may be implemented by executing instructions stored in a tangible, non-transitory, computer-readable medium (e.g., the memory 78 of the control system 58). For example, the method 100 may be performed at least in part by one or more software components, one or more hardware components, one or more software applications, and the like. While the method 100 is described using steps in a specific sequence, additional steps may be performed, the described steps may be performed in different sequences than the sequence illustrated, and/or certain described steps may be skipped or not performed altogether.

At block 102, a location of the viewing area 54 may be received. In particular, the viewing area 54 may be mobile and monitored for positioning relative to the image presentation system 52. By way of example, the location of the viewing area 54 may be indicative of a position of a ride vehicle on a track traversing proximate the first display 56. In some embodiments, the location of the viewing area 54 may correspond to a location (e.g., position) of an individual guest or viewer within the attraction system 50 (e.g., as detected using facial recognition or the like). Additionally, the location of the viewing area 54 may be pre-determined (e.g., programmed) based on timing or a set position for observation, such as the ride vehicle on the track, and retrievable from the memory 78 of the control system 58. In some embodiments, receiving the location of the viewing area 54 may include a user input, such as a request to operate the image presentation system 52. Further, in some embodiments, the location of the viewing area 54 may be received from one or more sensors positioned within the attraction system 50 and configured to continuously monitor the location and/or the position of the viewing area 54.

At block 104, the first image 82 may be received by and displayed on the first display 56. Further, the first display 56 may comprise the hole 74. As discussed herein, the first image 82 may be a scene or imagery that corresponds to the theme of the attraction system 50. Additionally, the first image 82 may be displayed by or projected onto the first display 56 and may be visible by the viewing area 54. The first image 82 may be displayed based on one or more parameters of the attraction system 50, such as a time of operation and/or the location of the viewing area 54 (e.g., the position of the ride vehicle relative to the first display 56). Further, the first image 82 may be displayed based on data received from the one or more sensors positioned within the attraction system 50 and configured to monitor the one or more parameters of the attraction system 50.

At block 106, the second image 84 may be received by and displayed on the second display 64. Further, the second display 64 may be disposed on the movable member (e.g., the movable arm 62) that extends through the hole 74 in the first display 56. In addition, as discussed herein, the second display 64 may be positioned so as to physically conceal the hole 74 from the viewing area 54. For example, the position of the movable arm 62 and thus the position of the second display 64 concealing the hole 74 is such that from the point of view of the guest (e.g., the viewer within the viewing area 54) the hole 74 cannot be perceived or clearly perceived by the guest. Moreover, as discussed herein, the second image 84 presented on the second display 64 effectively conceals the second display 64 from the point of view of the viewer by presenting as though the first image 82 and the second image 84 are a single image displayed by the first display 56. Additionally, the second image 84 may be displayed by or projected onto the second display 64 and may be visible by the viewing area 54. The second image 84 may be displayed based on the one or more parameters of the attraction system 50, such as the time of operation, the location of the viewing area 54 (e.g., the position of the ride vehicle relative to the first display 56), the location of the movable arm 62, or any combination thereof.

At block 108, an additional location of the viewing area 54 may be received. By way of example, the additional location of the viewing area 54 may be indicative of an additional position of a ride vehicle on a track traversing proximate the first display 56. In some embodiments, the additional location of the viewing area 54 may correspond to an additional location (e.g., position) of guest or viewer within the attraction system 50. Additionally, the additional location of the viewing area 54 may be pre-determined (e.g., programmed), such as the ride vehicle on the track, and retrievable from the memory 78 of the control system 58. In some embodiments, receiving the additional location of the viewing area 54 may include a user input, such as a request to operate the image presentation system 52. Further, in some embodiments, the additional location of the viewing area 54 may be received from one or more sensors positioned within the attraction system 50 and configured to continuously monitor the location and/or the position of the viewing area 54.

At block 110, an actuation system of the movable member of the image presentation system 52 may be instructed to move the movable member based on receiving the additional location of the viewing area 54. In particular, the show figure 66 and the second display 64 may be coupled to the movable member, and movement of the movable member via the actuation system may collectively move the show figure 66 and the second display 64 as a unit. By way of example, an actuator of the movable arm 62 may be instructed to move the movable arm 62 and, as a result, move the second display 64 and the show figure 66 resulting in the second display 64 continuing to conceal the hole 74 in the first display 56 from the point of view of the viewing area 54. As discussed herein, the viewing area 54 may be mobile. In other words, the location of the viewing area 54 and thus the point of view of the viewing area 54 with regards to the first display 56, the show figure 66, and the second display 64 may change over time. As the point of view changes, the actuator may be instructed to move the movable arm 62 based on receiving the additional location of the viewing area 54 to maintain concealment of the hole 74 in the first display 56. The actuation system may additionally, or alternatively, move the support in a manner that complements or supplements other operation of the attraction system. By way of example, the actuation system may be instructed to move the movable member, which results in movement of the show figure 66 based on the one or more parameters of the attraction system 50, such as the time of operation. The instruction of the actuator of the movable member may be pre-determined (e.g., programmed) and retrievable from the memory 78 of the control system 58. In some embodiments, the instruction to the actuator of the movable member may include a user input, which may be indicative of a requested positioning or requested movement of the movable member, the show figure 66, the second display 64, or any combination thereof.

At block 112, a third image 90 (e.g., imagery, video imagery, image data) may be received by and displayed on the second display 64. Further, as discussed herein, the second display 64 may be disposed on the movable member (e.g., the movable arm 62) that extends through the hole 74 in the first display 56. In addition, the second display 64 may be positioned so as to physically conceal the hole 74 from the viewing area 54. For example, the position of the second display 64 concealing the hole 74 is such that from the point of view of the guest or viewer within the viewing area 54 the hole 74 effectively cannot be perceived by the viewer. Moreover, the third image 90 presented on the second display 64 effectively conceals the second display 64 from the point of view of the viewer by presenting as though the first image 82 and the third image 90 are a single image displayed by the first display 56. Additionally, the third image 90 may be displayed by or projected onto the second display 64 and may be visible by the viewing area 54. Further, the third image 90 may be displayed based on the one or more parameters of the attraction system 50, such as the time of operation, the location of the viewing area 54 (e.g., the position of the ride vehicle relative to the first display 56), the location of the movable arm 62, or any combination thereof.

FIG. 6 is a flowchart of an embodiment of a method or process 200 for operating the image presentation system (e.g., the image presentation system 52 of FIGS. 1-4) of the attraction system 50. Any suitable device (e.g., the processing circuitry 80 of the control system 58 of FIGS. 1-3) may perform the method 200. In one embodiment, the method 200 may be implemented by executing instructions stored in a tangible, non-transitory, computer-readable medium (e.g., the memory 78 of the control system 58). For example, the method 200 may be performed at least in part by one or more software components, one or more hardware components, one or more software applications, and the like. While the method 200 is described using steps in a specific sequence, additional steps may be performed, the described steps may be performed in different sequences than the sequence illustrated, and/or certain described steps may be skipped or not performed altogether.

At block 202, a location of the movable member (e.g., the movable arm 62) may be received. By way of example, the location of the movable arm 62 may be indicative of a position of the show figure 66 and the second display 64 coupled to the movable arm 62. Further, the location of the movable arm 62 may be pre-determined (e.g., programmed), such as pre-determined positioning of the show figure 66 within the image presentation system 52, and retrievable from the memory 78 of the control system 58. In some embodiments, receiving the location of the movable arm 62 may include a user input, such as a request to operate the image presentation system 52.

Further, in some embodiments, the location of the movable arm 62 may be received from one or more sensors positioned within the attraction system 50 and configured to continuously monitor the location and/or the position of the movable arm 62 and/or the show figure 66.

At block 204, the first image 82 may be received by and displayed on the first display 56. Further, the first display 56 may comprise the hole 74. As discussed herein, the first image 82 may be a scene or imagery that corresponds to a theme of the attraction system 50. Additionally, the first image 82 may be displayed by or projected onto the first display 56 and may be visible by the viewing area 54. The first image 82 may be displayed based on one or more parameters of the attraction system 50, such as a time of operation and/or the location of the viewing area 54 (e.g., the position of the ride vehicle relative to the first display 56). Further, the first image 82 may be displayed based on data received from the one or more sensors positioned within the attraction system 50 and configured to monitor the one or more parameters of the attraction system 50.

At block 206, the second image 84 may be received by and displayed on the second display 64. Further, as discussed herein, the second display 64 may be disposed on the movable member (e.g., the movable arm 62) that extends through the hole 74 in the first display 56. In addition, the second display 64 may be positioned so as to physically conceal the hole 74 from the viewing area 54. For example, the position of the movable arm 62 and thus the position of the second display 64 concealing the hole 74 is such that from the point of view of the guest (e.g., the viewer within the viewing area 54) the hole 74 effectively cannot be perceived by the guest. Moreover, as discussed herein, the second image 84 presented on the second display 64 effectively conceals the second display 64 from the point of view of the viewer by presenting as though the first image 82 and the second image 84 are a single image displayed by the first display 56. Additionally, the second image 84 may be displayed by or projected onto the second display 64 and may be visible by the viewing area 54. The second image 84 may be displayed based on the one or more parameters of the attraction system 50, such as the time of operation, the location of the viewing area 54 (e.g., the position of the ride vehicle relative to the first display 56), the location of the movable arm 62, or any combination thereof.

At block 208, an additional location of the movable member (e.g., the movable arm 62) may be received. By way of example, the additional location of the movable arm 62 may be indicative of an additional position of the show figure 66 and the second display 64 coupled to the movable arm 62. Further, the additional location of the movable arm 62 may be pre-determined (e.g., programmed), such as pre-determined positioning of the show figure 66 within the image presentation system 52, and retrievable from the memory 78 of the control system 58. In some embodiments, receiving the additional location of the movable arm 62 may include a user input, such as a request to operate the image presentation system 52. Further, in some embodiments, the additional location of the movable arm 62 may be received from one or more sensors positioned within the attraction system 50 and configured to continuously monitor the location and/or the position of the movable arm 62 and/or the show figure 66.

At block 210, the third image 90 (e.g., imagery, video imagery, image data) may be received by and displayed on the second display 64. Further, as discussed herein, the second display 64 may be disposed on the movable member (e.g., the movable arm 62) that extends through the hole 74 in the first display 56. In addition, the second display 64 may be positioned so as to physically conceal the hole 74 from the viewing area 54. For example, the position of the second display 64 concealing the hole 74 is such that from the point of view of the guest or viewer within the viewing area 54 the hole 74 effectively cannot be perceived by the viewer. Moreover, the third image 90 presented on the second display 64 effectively conceals the second display 64 from the point of view of the viewer by presenting as though the first image 82 and the third image 90 are a single image displayed by the first display 56. Additionally, the third image 90 may be displayed by or projected onto the second display 64 and may be visible by the viewing area 54. Further, the third image 90 may be displayed based on the one or more parameters of the attraction system 50, such as the time of operation, the location of the viewing area 54 (e.g., the position of the ride vehicle relative to the first display 56), the location of the movable arm 62, or any combination thereof. It should be understood that methods 100 and 200 of the image presentation system 52 may operate (e.g., be implemented) simultaneously to offset, supplement, and/or complement one another to effectively produce the desired visual entertainment (e.g., optical illusion) to the viewing area 54, as discussed herein.

While only certain features of the invention have been illustrated and described herein, many modifications and changes will occur to those skilled in the art. It is, therefore, to be understood that the appended claims are intended to cover all such modifications and changes as fall within the true spirit of the invention.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for (perform)ing (a function) . . . " or "step for (perform)ing (a function) . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An image presentation system, comprising:

a first display with an opening extending therethrough, wherein at least a portion of the first display is viewable from a viewing area;

a movable arm, wherein the movable arm is positioned within the opening;

a second display supported by the movable arm and offset from the first display, wherein the second display is configured to conceal the opening from the viewing area; and a controller configured to:

provide first imagery via the first display;

provide second imagery via the second display in coordination with the first imagery based on a location of the viewing area, wherein the first imagery and the second imagery combine to present toward the location of the viewing area as though the first imagery and the second imagery are first unified imagery displayed by the first display;

receive an indication of an updated location of the viewing area; and provide third imagery via the second display in coordination with the first imagery of the first display based on the updated location of the viewing area, wherein the first imagery and the third imagery combine to present toward the updated location of the viewing area as though the first imagery and the third imagery are second unified imagery displayed by the first display.

2. The image presentation system of claim 1, comprising an animated figure coupled to the movable arm.

3. The image presentation system of claim 2, comprising a support structure coupling the movable arm and the animated figure such that the animated figure is at least partially positioned between the second display and the viewing area.

4. The image presentation system of claim 3, wherein a portion of the animated figure is configured to conceal the support structure from the viewing area.

5. The image presentation system of claim 1, wherein the movable arm comprises an articulating robotic arm with at least two degrees of freedom.

6. The image presentation system of claim 1, wherein the viewing area is mobile between at least the location and the updated location.

7. The image presentation system of claim 6, wherein the first imagery comprises first video imagery, the second imagery comprises second video imagery, and the controller is configured to modify the first video imagery and the second video imagery based on a changing location of the viewing area.

8. The image presentation system of claim 7, wherein the movable arm is configured to move based on the changing location of the viewing area to conceal the opening and the movable arm from the changing location of the viewing area.

9. The image presentation system of claim 6, wherein the viewing area comprises a ride vehicle configured to traverse a path proximate the first display and the second display.

10. The image presentation system of claim 1, comprising one or more projectors configured to project the first imagery on the first display and the second imagery on the second display.

11. The image presentation system of claim 10, wherein the controller is configured to control the one or more projectors to provide an image effect based on positioning of the second display relative to the first display and/or positioning of the viewing area relative to the second display such that the first imagery and the second imagery combine to appear as, from a perspective of the location of the viewing area, a unified image.

12. The image presentation system of claim 1, comprising a projector, wherein the first display comprises a backlit display configured to generate the first imagery and the second display comprises a screen upon which the projector projects the second imagery.

13. The image presentation system of claim 1, wherein the first display and the second display have complementary geometries.

14. The image presentation system of claim 13, wherein the first display and the second display are both substantially flat or each comprises complementary curves.

15. The image presentation system of claim 1, wherein the movable arm extends through the second display and couples with a prop or animated figure that is positioned between the second display and the viewing area.

16. A method, comprising:

receiving, via a controller, data indicative of a first point of view of a viewer based on a first location of a viewing area configured to be occupied by the viewer;

controlling display, via the controller, of first imagery on a first display, wherein the first display comprises opening;

controlling display, via the controller, of second imagery on a second display disposed on a movable member extending through the opening based on the data indicative of the first point of view of the viewer, wherein the second display is positioned to conceal the opening from the first point of view of the viewer, and wherein the second imagery is configured to conceal the second display by combining with the first imagery and presenting toward the first location of the viewing area as though the first imagery and the second imagery are a first unified imagery displayed by the first display from the first point of view of the viewer;

receiving, via the controller, additional data indicative of a second point of view of the viewer based on a second location of the viewing area; and controlling display, via the controller, of third imagery on the second display based on the additional data indicative of the second point of view of the viewer, wherein the second display is positioned to conceal the opening from the second point of view of the viewer, and wherein the third imagery is configured to conceal the second display by combining with the first imagery and presenting toward the second location of the viewing area as though the first imagery and the third imagery are a second unified imagery displayed by the first display from the second point of view of the viewer.

17. The method of claim 16, comprising instructing, via the controller, an actuator of the movable member to move the second display to conceal the opening from the second point of view of the viewer based on receiving the additional data indicative of the second point of view of the viewer.

18. The method of claim 16, comprising an animated object coupled to the movable member such that the animated object is at least partially positioned between the second display and the viewer.

19. A non-transitory computer-readable medium comprising instructions that, when executed by processing circuitry, cause the processing circuitry to perform operations comprising:

determining first image data for presentation via a first display, the first display having an opening extending therethrough;

initiating presentation of first imagery based on the first image data on the first display;

determining second image data for presentation via a second display supported by a movable arm extending through the opening, wherein determining the second image data is based on data indicative of a first position of a viewing area relative to the second display;

initiating presentation of second imagery based on the second image data on the second display, wherein the second display is offset from the first display and the second display conceals the opening from the first position of the viewing area, and wherein the second imagery comprises a first image effect that coordinates with the first imagery to present as though the first imagery and the second imagery are a first unified imagery displayed by the first display;

determining third image data for presentation via the second display based on additional data indicative of a second position of the viewing area relative to the second display; and initiating presentation of third imagery based on the third image data on the second display, wherein the second display conceals the opening from the second position of the viewing area, and wherein the third imagery comprises a second image effect that coordinates with the first imagery to present as though the first imagery and the third imagery are a unified imagery displayed by the first display.

20. The non-transitory computer-readable medium of claim 19, comprising the instructions that, when executed by the processing circuitry, cause the processing circuitry to perform the operations comprising instructing an actuator of the movable arm to move the second display to conceal the opening from a point of view associated with the second position of the viewing area based on receiving the additional data indicative of the second position of the viewing area.

* * * * *